United States Patent [19]

Sampson

[11] Patent Number: 4,765,167

[45] Date of Patent: Aug. 23, 1988

[54] METHOD OF ROLL FORMING PISTON

[75] Inventor: Sheldon E. Sampson, Davisburg, Mich.

[73] Assignee: Koppy Corporation, Ferndale, Mich.

[21] Appl. No.: 937,784

[22] Filed: Dec. 4, 1986

[51] Int. Cl.[4] ..... B21K 1/18

[52] U.S. Cl. ..... 72/68; 29/156.5 R; 72/84

[58] Field of Search ..... 72/68, 84, 110; 29/156.5 R; 92/172, 208, 214

[56] References Cited

U.S. PATENT DOCUMENTS

| | | | |
|---|---|---|---|
| 3,648,503 | 3/1972 | Harper | 72/84 |
| 4,023,250 | 5/1977 | Sproul et al. | 72/84 |
| 4,144,732 | 3/1979 | Franks et al. | 72/84 |

FOREIGN PATENT DOCUMENTS

| | | | |
|---|---|---|---|
| 570844 | 2/1959 | Canada | 72/84 |

*Primary Examiner*—Lowell A. Larson

*Attorney, Agent, or Firm*—Cullen, Sloman, Cantor, Grauer, Scott & Rutherford

[57] ABSTRACT

The method of forming an annular piston with a central hub, a radial pressure face and an outer cylindrical flange having an outwardly opening annular seal receiving groove which comprises the steps of forming an annular sheet metal stamping having an axial hub portion, an annular radial pressure face and an axial cylindrical flange with an annular free end portion; rotating the stamping while radially and axially supporting the hub; radially inwardly rolling and permanently deforming the flange into U-shape while simultaneously axially compressing and bending the free end portion radially inward throughout 360°. The method further includes upon the stamping an axial hub portion terminating in a radial inwardly directed first flange; radially and axially supporting the hub portion adjacent its opposite ends while rotating the stamping; radially and axially supporting the first flange; radially inwardly rolling and permanently deforming part of the hub portion into an internal second flange axially spaced from the first flange while simultaneously axially compressing the hub portion relative to the first flange, the flanges defining an internal annular seal receiving groove.

13 Claims, 3 Drawing Sheets

Fig-1
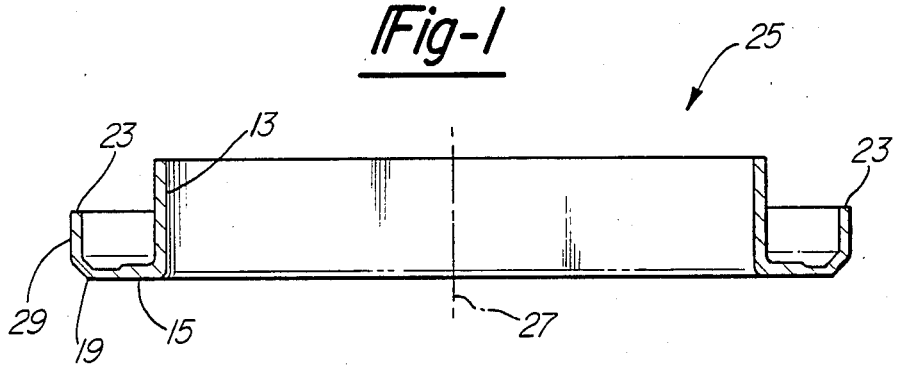
Fig-2
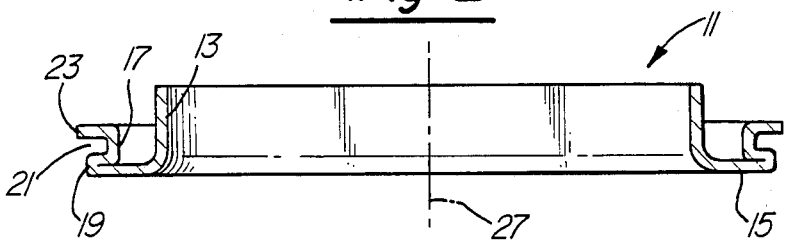
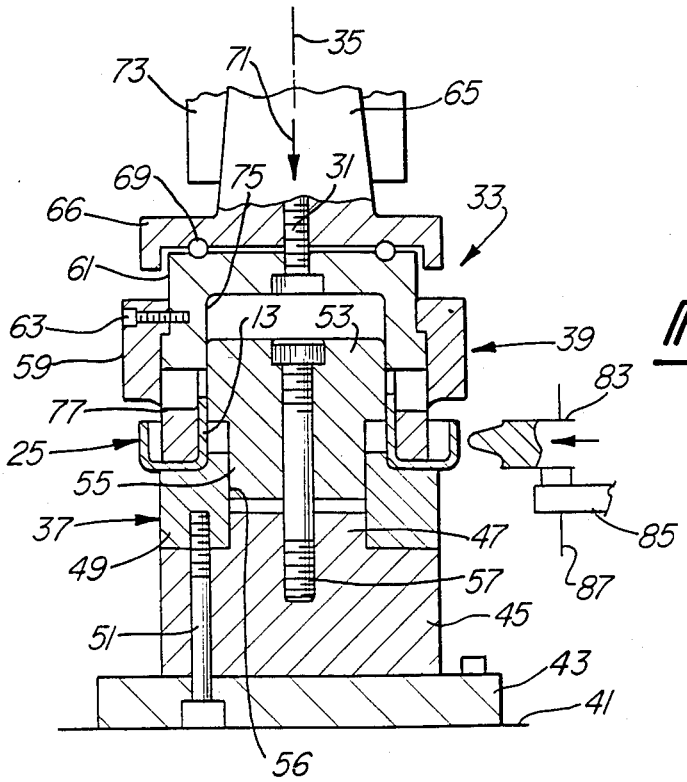
Fig-3

Fig-4
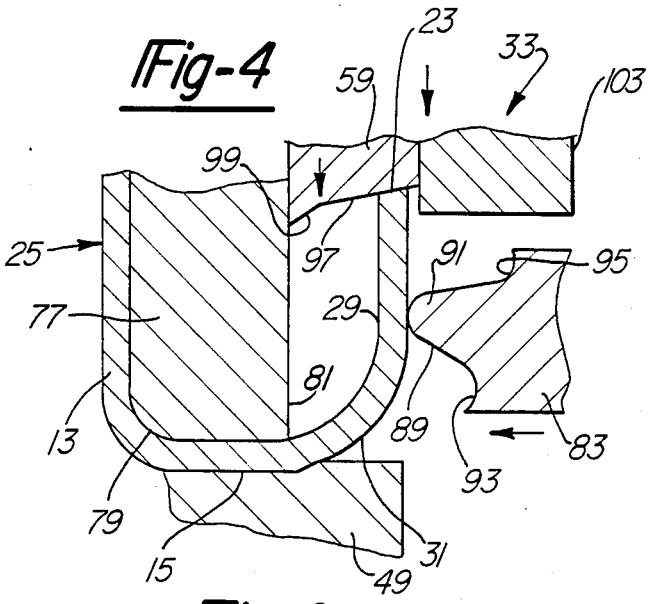
Fig-5
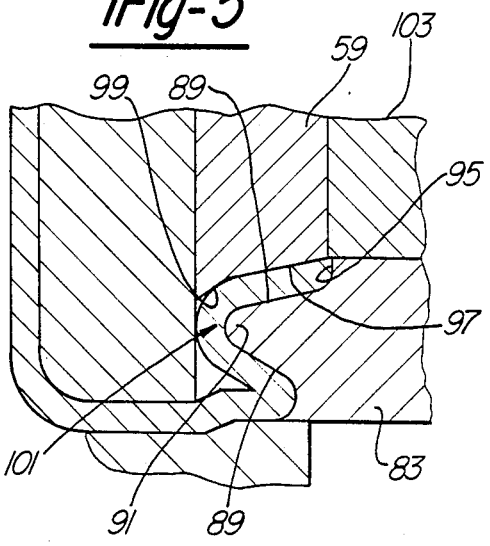
Fig-6
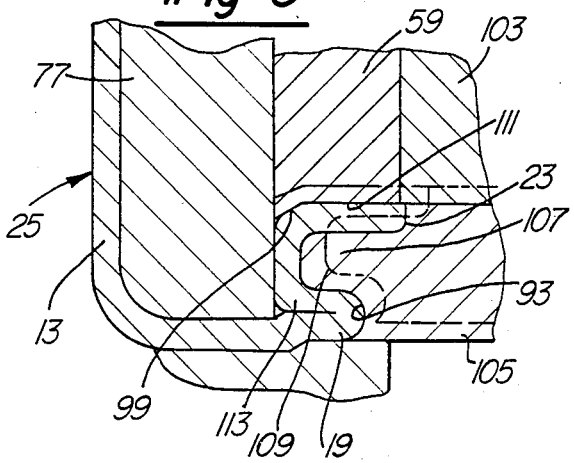
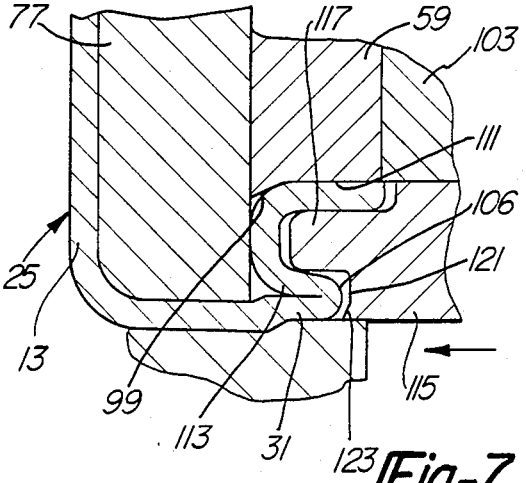
Fig-7
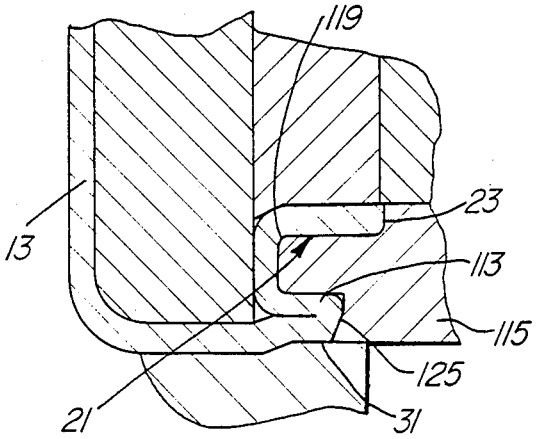
Fig-8

METHOD OF ROLL FORMING PISTON

FIELD OF INVENTION

The present invention relates to a series of method steps particularly, although not exclusively for forming a sheet metal stamping into an annular piston which has an axial hub, a radial pressure face, and an outer axial flange of cylindrical form having an outwardly opening seal receiving groove therein.

BACKGROUND OF THE INVENTION

Heretofore, pistons have been constructed primarily as die castings or from multiple piece stampings and wherein the multiple parts are assembled and welded. Heretofore, pistons have been made of assembled multiple parts and wherein outer annular portions have been machined to define an outwardly opening annular seal receiving groove.

The difficulty with pistons of the prior art of this type are that die cast pistons are of relatively high cost and often include porousity problems. In the manufacture of multiple part pistons, there is excessive time consumption in the accurate assembling of the respective parts and securing them together by welding or otherwise.

THE PRIOR ART

Reference is made to U.S. Pat. No. 4,485,656 dated Dec. 4, 1984, inventor: Carl A. Nilson et al. The patent is directed to a method of making a transmission piston from a stamping which includes a hub, a pressure face and an exterior cylindrical annular flange. There is extruded from the flange an annular outwardly directed channel, wherein no bending is involved and the flange is axially restrained against deflection. The compressive action of a roller against the rotating fixture extrudes the metal of the annular flange so as to form a pair of spaced radial ribs which are extruded from the flange portion outer surface as the flange is compressed, thereby maintaining a constant radial dimension of the flange portion.

SUMMARY OF THE INVENTION

An important feature of the present invention is to provide a method for forming an annular piston in one piece, wherein the annular piston includes an annular sheet metal stamping having a central axis, an axial annular hub portion, and an annular radial pressure face terminating in an axial cylindrical flange, which is roll formed into an outwardly opening seal receiving groove.

An important feature is to provide an improved method which includes forming an annular sheet metal stamping and rotating the stamping about its axis while radially and axially supporting the hub and radially and inwardly and permanently deforming the flange into a U-shaped configuration while simultaneously compressing and axially and permanently bending its free end portion radially outward throughout 360°.

A further feature of the method of this invention includes a radial pressure face having a transition portion of reduced thickness which terminates in the axial cylindrical flange and wherein, during axial compression, radially and permanently deforming the opposite end of the U-shaped portion of the flange onto the transition portion throughout 360°.

Another feature includes the progressive forming of the U-shaped configuration into the axial flange by a plurality of annular forming rollers wherein the successive rollers are progressively shaped to more accurately form the outwardly opening U-shaped configuration.

The present method provides an annular piston which is particularly adapted for an automatic transmission, though not limited thereto, and wherein during the step of radially inwardly rolling and permanently deforming the annular flange into a U-shaped configuration, and while simultaneously compressing axially and bending the free end portion radially outward, the free end portion is compressively and axially retained during deforming of the flange and wherein the cylindrical flange is preferably laterally unsupported.

Another feature includes the method of rolling and deforming the cylindrical flange radially inward in a U-shaped configuration with the free end portion thereof rolled radially outwardly throughout 360° and the opposed end of the U-shaped portion if folded over the transition portion of the stamping.

An important feature of the present invention includes, in addition to the formation of an annular piston having an outwardly opening annular seal receiving groove at one end, there is provided thereon at its opposite end an annular internal seal receiving groove, wherein the sheet metal stamping is further formed with an axial annular hub portion which terminates in a radial inwardly directed circular first flange having a free end portion. During rotation of the stamping about its axis and radially and axially supporting the hub portion adjacent opposite ends and radially and axially supporting the first flange, there is the further step of radially, inwardly rolling and permanently deforming said hub portion axially of the first flange into an internal annular second flange parallel to and axially spaced from the first annular flange with the flanges defining an internal annular groove while simultaneously axially compressing the hub portion relative to the first annular flange.

These and other features and objects will be seen from the following specification and claims in conjunction with the drawings in which:

THE DRAWINGS

FIG. 1 is a transverse section of a stamping from which an annular piston is formed in accordance with the present method.

FIG. 2 is a similar view on a reduced scale of the finished annular piston made in accordance with the present method.

FIG. 3 is a fragmentary vertical section of a rotative die press supporting the stamping shown in FIG. 1.

FIG. 4 is a vertical section of a portion of the press on an enlarged scale showing the initial position of the forming roller adjacent the annular flange to be roll formed in accordance with the present method and on an increased scale with respect to FIG. 3.

FIG. 5 is a similar view showing the initial roll forming of the cylindrical flange into a V-shape configuration.

FIG. 6 is a similar view utilizing a different forming roller forming the flange into a U-shape.

FIG. 7 is a similar view using a third forming roller to more accurately form the flange channel.

FIG. 8 is a similar view showing the final formation of the flange portion with the outwardly opening seal receiving groove therein.

Figure 9:
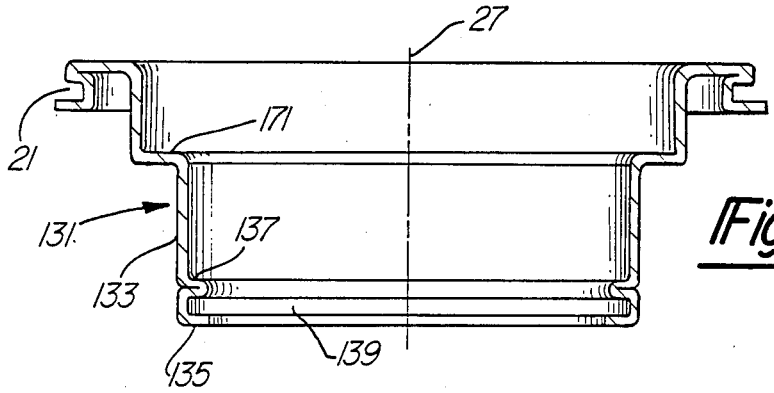
FIG. 9 is a vertical section of a modified piston which additionally includes at one end, an internal annular seal receiving recess.

FIGS. 10 through 13 fragmentarily show portions of the piston of FIG. 9 on an increased scale as including the annular hub portion which terminates in a first internal annular flange and fragmentarily the die apparatus successively through the forming stages resulting in the formation of the second annular flange in the axial hub portion.

It will be understood that the above drawings illustrate merely preferred embodiments of the present method, and that other embodiments are contemplated within the scope of the claims hereafter set forth.

DETAILED DESCRIPTION OF AN EMBODIMENT OF THE INVENTION

Referring to the drawings, FIGS. 1 through 8, the annular piston which may be used for a vehicle transmission, though not limited thereto, is shown at 11 in FIG. 2 and made in accordance with the present method. Said piston includes an axial hub portion 13 of cylindrical form and a radial pressure face 15. Said pressure face terminates in a transition portion 19 of reduced thickness from which extends an axial cylindrical flange 17 having a U-shaped configuration therein which defines the annular seal receiving groove 21. Flange 17 terminates at one end in the annular free end portion 23 which extends substantially at right angles to piston axis 27.

In accordance with the present method, the piston 11 is made by an initial step of forming an annular sheet metal stamping 25 of steel, aluminum or an equivalent material having a corresponding central axis 27 as shown in FIG. 1. Said stamping includes a corresponding axial hub portion 13, radial pressure face 15, thinned transition portion 19 and the cylindrical flange portion 29 whose free end 23, FIG. 1, corresponds to the free end 23 of the piston shown in FIG. 2 in its final formation.

The stamping 25, FIG. 3 shown on a reduced scale, is rotated about its axis 27 when mounted upon die press fixture 33. The die press fixture, of a conventional construction fragmentarily shown, is rotatable about its central vertical axis 35. Said fixture includes lower die half 37 and upper die half 39. which are relatively movable axially toward each other. The press fixture includes chuck plate 41, fragmentarily shown, rotatable upon axis 35, having a mount flange 43 for die support 45 which has a central circular boss 47.

Mounted upon the die support 45 and surrounding boss 47 is a lower die ring 49 retained upon the die support by fasteners 51. The axially adjustable guide block 53 has a shank 55 of reduced dimension positioned within bore 56 of lower die 49 which is adjustably secured to die support 45 by fastener 57.

The upper die half 39 of rotatable die fixture 33 includes an upper die ring 59 adapted for axial movements relative to lower die 49. Said upper die surrounds and is mounted upon a rotatable die support 61 which is slave driven in a conventional manner for rotation about axis 35 and is secured thereto by fastener 63. Tail stock 65, fragmentarily shown, is power rotated in a conventional manner and includes a pressure plate 66, which is connected to die support 61 by axial fastener 31 with a plurality of ball bearings 69 interposed.

In accordance with the present method, the die fixture 33 provides for the application of axial compressive force between the upper and lower die halves, as shown in the direction of arrow 71. Tail stock 65 is guidably and rotatably positioned within tail stock slide 73. In accordance with the conventional constructon of the rotative die fixture 33, the tail stock 65 is adapted to exert an axial compressive force upon upper die half 39 with respect to the relatively stationary lower die half 37 when moved axially from the position shown in FIG. 3 to the position shown successively in FIGS. 4 through 8. This movement is for compressively acting upon stamping 25 interposed between the upper and lower die halves of the rotative die press fixture. Die support 61 includes an axial bore 75 adapted to receive the guide block 53 in order to maintain proper alignment between the upper and lower die halves during relative movements. As shown in FIG. 3, the formed blank 25 is mounted upon lower die 49.

Annular stamping blank hold down ring 77 is positioned over and around blank 25 to axially and retainingly engage the hub 13. External portions of guide block 53 axially engage outer portions of hub 13, FIG. 3. The cylindrical flange 29 of the blank of FIG. 1, as positioned upon the die fixture is spaced outwardly from anchor ring 77 and is laterally unsupported. In FIG. 3, the upper die half 39 of the die is elevated with respect to the lower die half 37. The anchor ring 77 is rectangular in cross-section and has a radiused internal corner 79, FIGS. 4 through 8, to supportably engage the axial hub where it joins radial face 15 of the blank.

In the mounting of the blank 25 within the rotative die fixture 33 fragmentarily shown on an enlarged scale in FIG. 4, radial pressure face 15 bears against lower die 49 and is axially supported thereon. The inner annular surface 81 of hold down ring 77 guidably receives the upper die 59 as fragmentarily shown in FIG. 4. The upper die half 39 has been moved axially and compressively downwardly relatively to the lower die half 37 of the die fixture, so that inclined forming surface 97 thereof is in operative engagement with the free end portion 23 of flange 29 of the stamping. As will be understood, downwardly and upwardly are relative terms and the positions of the die members may be reversed.

A first forming roller 83, as fragmentarily shown in FIG. 3, is journaled upon a support 85 and rotatable upon axis 87 parallel to axis 35 of die fixture 33. First forming roller 83, shown on an enlarged scale, by its transversely adjustable support 85 is brought into contact with flange 29, FIG. 4. In accordance with one of the steps of the present method, the present stamping 25 is mounted upon the die fixture 33 and rotatable about its axis 27, which corresponds to axis 35 of the die fixture, while radially and axially supporting its hub 13. The flange 29 is laterally unsupported as shown in FIG. 4. First forming roller 83 is of annular convex V form, being fragmentarily shown in FIGS. 4 and 5, and is idle supported for rotation about its axis 87 at the same time as it is forcefully fed radially inward, as shown by the arrow FIG. 4, to the position shown in FIG. 5.

The first forming roller 83 has a central convex converging rolling end portion 89 which terminates in a rounded portion 91. Said roller includes a lower inwardly curved concave die portion 93 and an annular curved die portion 95 on its opposite side. The first inclined die surface 97 of upper die 59, FIG. 4, terminates in a second inclined die surface 99, which assists in the formation of the V configuration shown in FIG. 5, as forming roller 83 is gradually fed radially and inwardly of flange 29 to the final position shown.

Concurrently with the step of radially and inwardly and permanently deforming the flange 29 into an V-configuration, as shown in FIG. 5, there is a simultaneous axial compression between the die halves, including die 59, that bends the free end portion 23 to extend radially outward. This occurs in accordance with the present method, wherein there is simultaneously compression axially with respect to the free end portion 23 from the position shown in FIG. 4 to the position shown in FIG. 5. The upper die half 39 has moved forcefully downwardly, relative to the lower die half 37, in a conventional construction for this type of die fixture upon which the stamping is mounted and anchored.

With the central portion of flange 29 rolled and deformed radially inward between FIGS. 4 and 5, the end portion 23 is bent downwardly by the upper die 59 to the position shown in FIG. 5. The bent down portion extends radially outward at an angle in registry with roller die surfaces 89 and 95. The convex roller die surface 91 forms the central portion of the V-shaped configuration 101. During initial formation of the configuration 101 by first roller die 83, FIG. 5, the roller hold down plate 103 is moved downwardly, from the position shown in FIG. 4 to the position shown in FIG. 5, so as to retain roller die 83 against axial displacement.

The U-shaped configuration is progressively formed by a plurality of forming rollers, wherein the additional rollers more accurately form the outwardly opening U-shaped configuration, FIGS. 6, 7 and 8. For this purpose, upon lateral retraction of forming roller 83 with respect to the rotating stamping as partly formed in FIG. 5, said roller is replaced by a second forming roller 105, as shown in FIG. 6, which is rotatable about the corresponding vertical axis 87, parallel to the fixture axis 35. Roller 105 is adapted to be fed inwardly by the same apparatus 87 forcefully towards axis 35, at right angles thereto, or radially inward.

The second forming roller 105 has an annular die portion which is more squared off as at 107, and which is generally rectangular in cross-section with rounded corners at 109. As shown in FIG. 6, the upper die 59 has been modified to show a flat die surface 111, which terminates in the inclined die surface 99. When further compressive force is exerted by the rotative die fixture, between the upper and lower halves thereof, die 59 moves downwardly, as does roller hold down plate 103, and the second forming roller 105 is fed radially inward relative to the previously formed flange. The free end portion 23 has now been permanently bent to extend radially outward and the internal corners of the outwardly opening channel 21 are more squared off.

In view of the reduced thickness of transition portion 31, as shown in FIGS. 1, 4 and 5, the inward feeding of forming roller 105 the rotative partly formed flange is deformed permanently. The opposite end 113 of the U-shaped portion 101 is bent over onto the transition portion 19, as shown in FIG. 6, for engagement therewith. This defines a laterally opening annular seal receiving groove 21 which extends throughout 360°. In this formation, the second die portion 99 of top die 59 has additionally served to assist in the formation of the curved portion between the top of the channel and its inner axial wall.

As a part of the present method and after the secondary formation of the channel shown in FIG. 6 and retraction radially outward of roller 105, fragmentarily shown, said roller is replaced by a third forming roller 115. This roller has a generally rectangular annular portion 117 with rounded corners 119 for finish forming of the outwardly opening groove 21, FIGS. 2 and 8. The roller 115 has a further flattened annular axial surface 121, which is tapered at 123, so that in the final formation the front end portion of the flange at 125 is partly flattened at the folded over portion 113, relative to transition portion 31, for the finish forming of the piston.

As the die fixture 33 is rotated and the respective rollers 83, 105 and 115 successively engage the cylindrical flange portion 29, spaced from the free end 23, said rollers successively form the U-shaped channel, wherein the transition portion 31, see FIGS. 6, 7 and 8, is bent permanently inwardly and the free end portion 23 is bent outwardly, see FIGS. 5, 6 and 7. The second roller 105 has a generally square shaped rolling end portion 107 and die groove 93 which receives the elbow 106 of the transition portion and free end portion 23. The flange portion 107 of roller 105 closes the lower part of the U-configuration, forming an elbow. Groove 21 is U-shaped, as shown in FIGS. 6 and 7. Finally, the groove 21 is squared off by a third roller 115 whose rectangular flange 117 and rounded corners sharpen up the U-shaped configuration forming the final configuration, see FIGS. 2 and 8.

MODIFIED METHOD

A modified piston 131, which may also be used for a vehicle transmission, though not limited thereto, includes an outwardly opening annular seal receiving groove 21, corresponding to groove 21 of FIG. 2. Additionally, as a part of the stamping, the piston includes an axial hub portion 133, which terminates at an end opposite groove 21 in an internal circular end flange 135, sometimes referred to as a first annular flange. Radially thereof and spaced axially therefrom is a second internal annular flange 137 for defining between the flanges an internal annular seal holding groove 139, FIG. 9. The remaining figures in the drawings, FIGS. 10 through 13, are directed to apparatus similar to the rotatable fixture apparatus of FIG. 3 adapted for supporting and rotating the stamping blank. In the modified piston 131, extending from radial portion 171, is the annular hub portion 133, fragmentarily shown, for the formation of an internal annular seal receiving groove 139 by the present method.

The die fixture 143, 144, conventional in construction, is schematically and fragmentarily shown in FIGS. 10–13, within which the die formed stamping blank portion 141 is mounted and supported, being formed of sheet metal. Said blank portion includes axial hub portion 133, which terminates at one end in a curved surface 142 terminating in first flange 135, mounted and anchored upon rotatable die fixture 143, 144.

Said die fixture includes lower internal hold down die ring 145 having an annular die flange 147 of reduced height and of general rectangular shape with rounded corners 149. Die flange 147 cooperatively and retainingly engages first flange 135 at the lower end of hub portion 133. Flange 135 is interposed between lower die 151 and die 147. Lower die 151 includes an upright support flange 153 having an axial support surface 155 adapted for axially retaining engagement with one end of hub portion 133, adjacent first flange 135. Lower die 151 includes the curved die surface 157 for the curved transition portion 142 between hub portion 133 and flange 135, FIGS. 11, 12 and 13.

Figure 10:
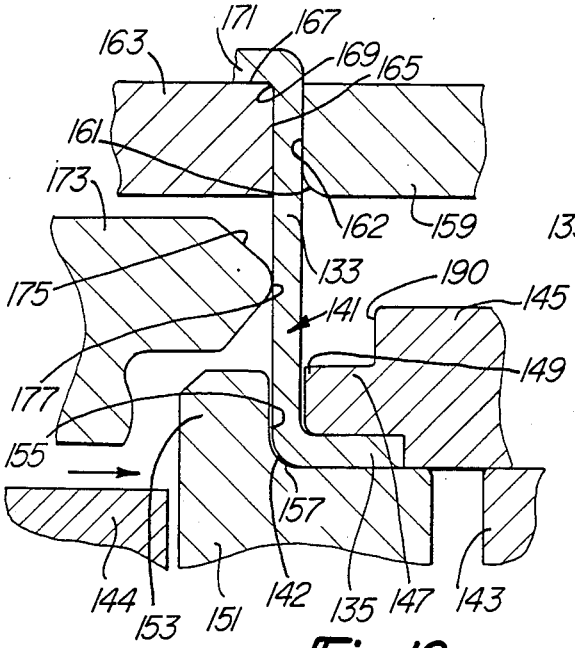
Figure 11:
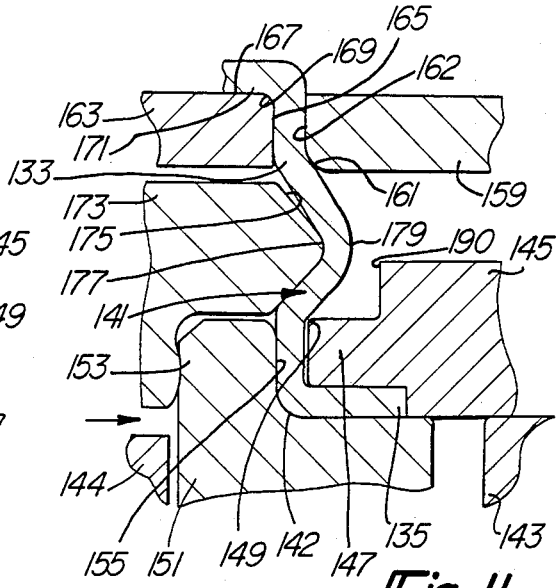
Figure 12:
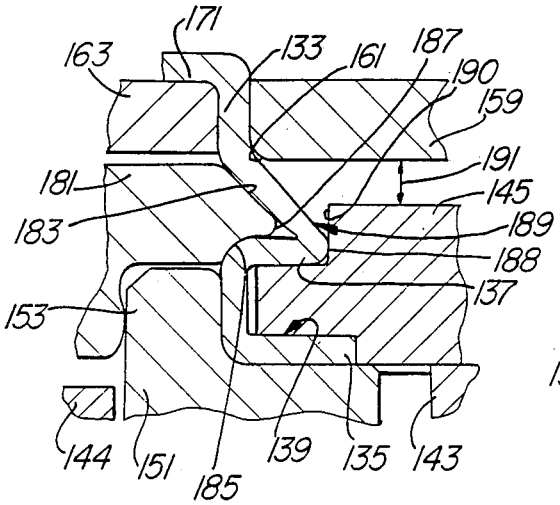
Figure 13:
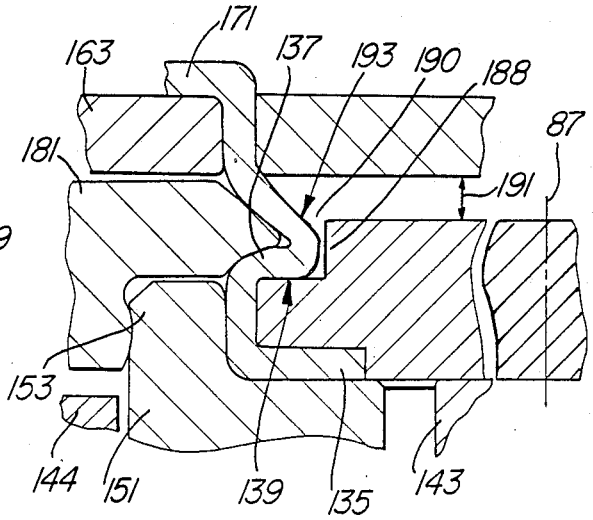

Upper internal die 159 is adapted and radially support upper parts of hub portion 133 and includes a curved forming portion 161 to assist in the bending of the hub portion, FIGS. 11, 12 and 13. Upper die 159 includes an axial support surface 162 adapted to axially and supportably engage another end portion of hub portion 133, FIG. 10. Upper outer die 163 includes an axial support surface 165 to radially and axially engage hub portion 133. Die 163 has a radial support surface 167 for axially supporting the radial piston portion 171, fragmentarily shown. Upper outer die 163 has a rounded support corner 169 for registry with the juncture between radial piston portion 171 and hub portion 133.

A first forming roller 173 is shown in FIG. 10, being idle supported upon a vertical axis similar to axis 87 of FIG. 3 upon a support corresponding to support 85, and is adapted for radial inward feed movements against hub portion 133 in the manner above described with respect to FIG. 5. A corresponding support similar to support 85 is adapted to compressively advance the respective die roller 173 radially inward relative against hub portion 133.

The first forming roller 173 includes the tapered convex nose 175 with a rounded end 177 adapted to form a first groove of U-shape and a corresponding U-shaped portion 179, FIG. 11, as roller 173 is forcefully fed radially inward during rotation of fixture 143, 144, FIG. 11, stopping against die flange 153.

At the same time as roll 173 during rotation of the hub portion 133 has formed the arcuate portion 179 there has been a simultaneous compressive relative movement of the upper and lower dies with respect to each other as in the fixture press such as described with respect to FIG. 3. The hub portion 133 is in axial compression during inward feeding of first roller 173, FIG. 11. Here, the upper end of the hub portion 133 engages and extends around curved die surface 161 of upper die 159 as it is successively employed in FIGS. 12 and 13.

After retraction of the first forming roller 173, said roller is replaced by a second forming roller 181, FIG. 12. In FIG. 12, the first forming roll 173 of FIGS. 10 and 11 has been replaced by the second forming roller 181 of a progressively different shape which includes a tapered flattened die surface portion 183 on one side, a concave die surface 185 and a rounded end 187 of reduced diameter compared to the rounded end 177 of first roller 173, FIG. 10. Thus, the successive forceful radial inward feeding of roller 181 against the unsupported hub portion 133 continues to form the second flange 137. A transition portion 188 is operatively and retainingly engaged by the radial die portion 190 forming a part of lower die 145. Roller 153 stops against flange 153.

Concurrently with this formation, there is compressive movement of upper die 159 with respect to lower die 145 to form second flange 137, FIG. 13. Said compression is designated at 191, FIGS. 12 and 13, to provide the final formation 193 for the second flange 137 axially spaced from first flange 135. Second flange 137 defines with first flange 135 the inwardly directed internal seal receiving groove 139, FIGS. 9 and 13.

In the modification of the present piston and for the method of forming the internal annular groove 139 throughout 360° upon end end of piston 131, FIG. 9, the annular sheet metal stamping has a corresponding central axis 27 which registers with fixture axis 35. In the initial rolling and deforming step there is provided an annular sheet metal stamping having an axial hub portion 133, FIG. 10, which terminates in the radial inwardly directed circular first flange 135, which has a free end portion. The stamping is suitably mounted and supported upon the rotative die fixture 143, 151, schematically shown in FIGS. 10 through 13, while radially and axially supporting the hub portion 133 adjacent at its opposite ends, FIG. 10. The method further includes the step of radially and axially supporting the first flange 135 by the die elements 151, 153, 155, 145, 147, and 149.

The method further includes radially, inwardly rolling and permanently deforming the hub portion 133 axially from the first flange 135 into an internal annular second flange 137 which is parallel to and axially spaced from the first annular flange 135 and wherein between the flanges is defined the internal annular groove 139. The method further includes during the radial and permanent deforming of the hub portion 133, the simultaneous axial compression of the hub portion relative to the first annular flange 135 employing the respective die elements 159, 161, 163, 145, and 151, shown in FIGS. 10 through 13.

The deformation of the second flange 137 within hub portion 133 is a permanent deformation in the final shape, FIG. 13. Shown in FIG. 9 and FIGS. 10 through 13, the second annular flange 127 at its inner edge has a radius which is greater than the radius at the inner edge of the first annular flange 135.

Having described my invention, reference should now be had to the following claims.

I claim:

1. A method of forming an annular piston having a central hub portion, a radial pressure face and an outer cylindrical flange having an outwardly opening annular seal receiving groove comprising the steps:

(a) forming an annular sheet metal stamping having a central axis, a generally cylindrical central hub portion, a radially extending portion having a radial pressure face, and an axial cylindrical flange having an annular free end portion with a transition portion of reduced thickness located between said flange and said pressure face;

(b) rotating the stamping about its axis while radially and axially supporting said hub portion;

(c) journaling an annular forming first roller of convex shape upon an axis parallel to said stamping axis;

(d) progressively feeding said first roller transversely into said flange while simultaneously axially compressing and permanently bending the free end portion radially outward to form a radially, inwardly concave groove;

(e) replacing said first roller with an annular forming second roller of generally rectangular shape;

(f) progressively feeding said second roller transversely into said flange while further compressing the free end portion to form said groove into generally U-shape and to partially fold said transition portion;

(g) successively replacing said second roller with an annular forming third roller of final rectangular shape; and (h) progressively feeding said third roller into said flange to further fold said transition portion into a folded over portion and to form a partially flattened outer surface of said transition portion.

2. In the method of claim 1, wherein the axially compressing and radially and permanently deforming of the opposite end of the U-shaped portion of the cylindrical flange onto said transition portion being throughout 360 degrees.

3. In the method of claim 1, the U-shaped configuration being progressively formed by a plurality of successive annular forming rollers of different shape, wherein the additional rollers more accurately form the outwardly opening U-shaped configuration.

4. In the method of claim 1, wherein said cylindrical flange being laterally unsupported.

5. In the method of claim 1, including axially positioning and retaining said forming rollers successively against axial displacement along their respective axes.

6. A method of forming an annular piston having a central hub portion, a radial pressure face, an outer cylindrical flange at one end of the piston having an outwardly opening annular seal receiving groove and an axial hub portion terminating at the other end of said piston in an inwardly opening annular seal receiving groove, comprising the steps to form the inwardly opening groove of:

(a) forming an annular sheet metal stamping having a central axis, a generally cylindrical hub portion, terminating in a radial inwardly directed circular first annular flange having an annular free end portion;

(b) rotating the stamping about its axis while radially and axially supporting the hub portion adjacent its opposite ends;

(c) radially and axially supporting said first flange;

(d) journaling an annular forming first roller of convex shape upon an axis parallel to said stamping axis;

(e) progressively feeding said first roller transversely into said hub portion while simultaneously axially compressing said hub portion and radially, inwardly rolling and permanently deforming said hub portion axially of said first flange into an internal annular second flange parallel to and axially spaced from said first annular flange, said flanges defining an internal concave groove;

(f) replacing the first roller with an annular forming second roller of more sharply convergent shape;

(g) progressively feeding said second roller transversely into said hub portion while further compressing said hub portion to form said groove into substantially V-shape and continuing to feed said second roller transversely into said hub portion to at least partially fold said transition portion to finish forming said internal annular second flange.

7. In the method of claim 6, said second annular flange at its inner edge having a radius greater than said first annular flange at its inner edge.

8. In the method of claim 6, the second annular flange being formed by a plurality of successive forming rollers of progressively different annular shape to progressively and more accurately form said second flange and said internal groove.

9. In the method of claim 8, wherein the successively feeding of each of said rollers being transversely into said hub portion.

10. In the method of claim 6, wherein said hub portion adjacent the deforming thereof being laterally unsupported.

11. In the method of claim 6, said second annular flange at its inner edge having a radius greater than said first annular flange at its inner edge.

12. In the method of claim 6, the second annular flange being formed by a plurality of successive forming rollers of progressively different annular shape to progressively and more accurately form said second flange and said internal groove.

13. In the method of claim 6, wherein the axially compressing and radially and permanently deforming of the opposite end of the U-shaped portion of the cylindrical flange onto said transition portion being throughout 360 degrees.

* * * * *